US006456267B1

(12) United States Patent
Sato et al.

(10) Patent No.: US 6,456,267 B1
(45) Date of Patent: Sep. 24, 2002

(54) LIQUID CRYSTAL DISPLAY

(75) Inventors: Hideo Sato; Yoshiro Mikami; Makoto Tsumura, all of Hitachi; Tetsuro Minemura, Hitachiota; Yoshiharu Nagae, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/201,898

(22) Filed: Nov. 30, 1998

(30) Foreign Application Priority Data

Dec. 1, 1997 (JP) ..... 9-329865

(51) Int. Cl.[7] ..... G09G 3/36

(52) U.S. Cl. ..... 345/92; 345/90; 345/98; 345/87; 345/204; 345/205; 345/206; 345/209; 345/210; 345/214; 345/96

(58) Field of Search ..... 345/90, 92, 98, 345/96, 205, 206, 204, 209, 210, 214

(56) References Cited

U.S. PATENT DOCUMENTS 5,627,557 A 5/1997 Yamaguchi et al.
5,712,652 A * 1/1998 Sato et al. ..... 345/90
5,798,746 A * 8/1998 Koyama ..... 345/92
5,852,425 A * 12/1998 Bird et al. ..... 345/92
5,867,139 A * 2/1999 Tanaka et al. ..... 345/92
5,945,972 A * 8/1999 Okumura et al. ..... 345/98
6,011,533 A * 1/2000 Aoki ..... 345/92
6,064,361 A * 5/2000 Akiyama ..... 345/98
6,064,362 A * 5/2000 Brownlow et al. ..... 345/92

FOREIGN PATENT DOCUMENTS

JP 6-118912 4/1994
JP 9-258168 10/1997

* cited by examiner

*Primary Examiner*—Richard Hjerpe
*Assistant Examiner*—Ali Zamani
(74) *Attorney, Agent, or Firm*—Antonelli, Terry, Stout & Kraus, LLP

(57) ABSTRACT

A liquid crystal display has pixels in domains surrounded by data signal lines and scanning signal lines. Each of the pixels has a voltage holding device for a positive polarity and a voltage holding device for a negative polarity, two lines of voltage holding interconnections which always apply a maximum voltage and a minimum voltage of a voltage applied to the data signal lines formed for holding the voltage, and a switching device for switching between outputs from the voltage holding devices. One time or more within one frame time period thereof, the switching is performed between the voltage holding device for a positive polarity and the voltage holding device for a negative polarity.

12 Claims, 14 Drawing Sheets

LIQUID CRYSTAL DISPLAY

BACKGROUND OF THE INVENTION

The present invention relates to a liquid crystal display based on an active matrix system, and more particularly to a liquid crystal display in which MOS transistors on a single crystal silicon substrate or Thin-Film Transistors employing poly crystal silicon are used.

In order to clarify the present invention, a conventional active matrix driving system will be explained below: Incidentally, concerning an active matrix panel technology known up to the present time, it is explained in detail in Shunsuke Kobayashi. "Color Liquid Crystal Display" (published from Industrial Library Ltd. in 1990). Moreover, concerning a technology for preventing a flicker caused by leakage resistance of liquid crystal, it is described in JP-A-6-118912.

A liquid crystal display based on the active matrix system, in which MOS (Metal-Oxide Semiconductor) transistors on a single crystal silicon substrate or Thin-Film Transistors (TFT) employing poly crystal silicon are used, comprises a display unit and a driving circuit unit. The display unit is a unit in which transistors are located at the intersections of data signal lines and scanning signal lines arranged in a matrix-like structure. The driving circuit unit controls voltages for the data signal lines and the scanning signal lines.

In a transistor in the display unit, the gate is connected to a scanning signal line, the drain to a data signal line, and the source to a liquid crystal capacitor. Usually, a holding capacitor is added in parallel with the liquid crystal capacitor. Here, when the gate electrode comes into a selection state, the transistor is brought into conduction, thereby allowing an image signal on the data signal line to be written into the liquid crystal capacitor and the holding capacitor. When the gate electrode is changed into a non-selection state, the transistor has a high impedance, thus holding the image signal written in the liquid crystal capacitor.

The driving circuit unit comprises a scanning circuit for controlling the voltages for the scanning signal lines and a signaling circuit for controlling the voltages for the data signal lines. The scanning circuit applies a scanning pulse to each of the scanning signal lines once every one frame time. Usually, a timing of the scanning pulse toward each of the scanning signal lines is shifted in sequence from an upper side of a panel to a lower side thereof. A time of 1/60 second is often employed as the one frame time. In a panel of 640×480 dots, i.e. a representative pixel configuration, since 480 scannings are performed during the one frame time, a time width for the scanning pulse becomes equal to about 35 $\mu$s. A shift register is commonly used in the scanning circuit, and an operating rate of the shift register is equal to about 28 kHz.

Meanwhile, the signaling circuit applies, to each of the data signal lines, a liquid crystal driving voltage the value of which is equivalent to driving liquid crystal of pixels by a single row to which the scanning pulse is applied. In a pixel to which the scanning pulse is applied, a voltage of a gate electrode of the transistor, which is connected to a scanning signal line, becomes high, and thus the transistor is switched to ON state. At this time, the liquid crystal driving voltage is applied to the liquid crystal from a data signal line by way of a drain and a source of the transistor, thus charging a pixel capacitor comprising the liquid crystal capacitor and the holding capacitor. Repetition of this operation allows a signal voltage corresponding to an image, every frame time and repeatedly, to be applied to a pixel capacitor over the entire surface of the panel.

The liquid crystal driving voltage applied to the liquid crystal, by inverting the polarity thereof every frame time, is converted into an alternating voltage. When a frame frequency is equal to, as usual, 60 Hz, a liquid crystal driving frequency becomes equal to 30 Hz, i.e. one-half of the frame frequency. Also, the liquid crystal-driving voltage converted into the alternating voltage with positive and negative polarities is distorted by crosstalk, which is caused by the gate voltage when the transistor is switched from ON state to OFF state, or by the leakage resistance of the liquid crystal.

At the liquid crystal driving frequency of 30 Hz, the distortion of the liquid crystal-driving voltage causes people to feel and see a flickering light called flicker. In order to prevent the flicker from being perceived, it can be considered that a period of the liquid crystal driving voltage (a specific period of the voltage applied to pixel electrodes and having different polarities) is made shorter so that the flicker becomes imperceptible to human eyes. However, it is difficult to fabricate, with a stable yield, an active element for driving pixel electrodes in the conventional liquid crystal display. Also, as a method of making the flicker difficult to recognize visually with human eyes, there exists a driving method in which polarities of driving voltages applied to adjacent pixels are inverted. This is a method of applying signal voltages, the polarities of which are obtained by mutually inverting polarities of signal electrodes of the pixels which are adjacent in a right-to-left direction and those of signal electrodes of the pixels which are adjacent in an up-and-down direction.

SUMMARY OF THE INVENTION

It is an object of the present invention to provide a liquid crystal display which produces no flicker.

It is another object of the present invention to provide a liquid crystal display which, by miniaturizing transistors therein and lowering a withstanding voltage thereof, has a large aperture ratio and consumes less electric power.

In a liquid crystal display based on the conventional active matrix driving system, there occur the following problems:

First of all, a serious problem is the occurrence of the flicker. In the above-described liquid crystal display based on the active matrix driving system, the liquid crystal-driving voltage, by inverting the polarity thereof every frame time, is converted into the alternating voltage. As a result, when the frame frequency is equal to, as usual, 60 Hz, the liquid crystal driving frequency becomes equal to 30 Hz, i.e. one-half of the frame frequency. At the liquid crystal driving frequency of 30 Hz, the flickering light called flicker becomes perceptible. In order to prevent the flicker from being perceived, the driving method, in which polarities of driving voltages applied to adjacent pixels are inverted, is employed. This is the method of applying signal voltages, the polarities of which are obtained by mutually inverting polarities of signal electrodes of the pixels which are adjacent in a right-to-left direction and those of signal electrodes of the pixels which are adjacent in an up-and-down direction. The polarities of the signal electrodes, in the case of the above-mentioned panel of 640×480 dots, are inverted every one scanning time period, i.e. 35 $\mu$s. Accordingly, a driving frequency for the signal electrodes becomes equal to 14.4 kHz, i.e. about 500 times as great as the liquid crystal driving frequency. This situation brings about a decrease in the design flexibility.

Also, in the above-described driving method, when displaying a specific pattern such as a checkered pattern obtained by simultaneously displaying pixels to which voltages with an identical polarity are applied, the flicker becomes so conspicuous as to be recognized visually with human eyes.

A second problem is a high withstanding voltage of the transistors. In the above-described liquid crystal display based on the active matrix driving system, sampling of the voltage, the polarities of which are inverted every frame time by the transistors in the display unit, is performed, thereby controlling the liquid crystal-driving voltage. This requires that a withstanding voltage of the transistors in the display unit should be two times or more of an effective voltage for driving the liquid crystal, thus resulting in so much consumption of electric power. Meanwhile, concerning a small-sized and high resolution liquid crystal panel for a liquid crystal projector or a super high resolution liquid crystal display, in order to enhance the aperture ratio, the transistors are expected to be miniaturized. When miniaturizing the transistors through the microprocessings, the withstanding voltage thereof becomes an extremely serious obstacle.

A third problem is a reduction in impedance for driving the liquid crystal. In the above-described liquid crystal display based on the active matrix driving system, a transistor in the display unit allows an image signal, the sampling of which is performed using a scanning signal on a scanning signal line, to be applied to a holding capacitor and a liquid crystal capacitor, thereby controlling the liquid crystal. This makes it impossible for impedance of the liquid crystal to continue applying the voltage over one frame time period, i.e. a sampling period. In order to hold the voltage, a sufficiently large capacitor is needed. The impedance becomes a serious obstacle especially when guest host type liquid crystal is applied to the liquid crystal display.

Although, as described above, the present invention makes it possible to solve many problems, an important object thereof is to provide a liquid crystal display which allows the flicker to be eliminated.

A constitution of the present invention can be considered as follows: In a liquid crystal display which has a pair of substrates, a liquid crystal layer held by the pair of substrates in such a manner as to be sandwiched therebetween, and, on one of the pair of substrates, a plurality of scanning signal lines and a plurality of data signal lines which are formed in a matrix-like structure with reference to the plurality of scanning signal lines, a plurality of pixels are constituted in domains surrounded by the scanning signal lines and the data signal lines, and a pixel circuit, which applies to the liquid crystal layer, is formed in each of the pixels.

In this way, a pixel circuit formed in each pixel applies, to the liquid crystal layer, thereby making it possible to suppress the occurrence of the flicker.

Also, the pixel circuit is formed so that it has a first storing means for storing a liquid crystaldriving voltage for the present frame, a second storing means for storing a liquid crystal driving voltage for a one-preceding frame, and a switching means for switching between the first storing means and the second storing means.

Moreover, assuming that the liquid crystal driving voltage having a different polarity is a voltage obtained by alternately applying the liquid crystal-applied voltage for the present frame and the liquid crystal-driving voltage for a one-preceding frame, it becomes possible to apply, to the liquid crystal layer and without exerting essential influences on the other interconnections or without installing new interconnections, the one period or more of liquid crystal driving voltage which has a different polarity for every one frame.

As another means in the present invention, the following constitution can be considered: In a liquid crystal display which has a pair of substrates and a liquid crystal layer held by the pair of substrates in such a manner as to be sandwiched therebetween, one substrate of the pair of substrates has a plurality of first scanning signal lines, a plurality of second scanning signal lines formed between the plurality of first scanning signal lines, and a plurality of data signal lines formed in a matrix-like structure with reference to the plurality of first scanning signal lines and the plurality of second scanning signal lines, and a plurality of pixel circuits, which drive liquid crystal molecules connected to the first scanning signal lines, the second scanning signal lines and the data signal lines, are formed in domains surrounded by these interconnections, and each of the pixel circuits is constituted so that it has a first voltage holding means connected to a corresponding first scanning signal line and a corresponding data signal line so as to hold an image signal voltage from the data signal line, a second voltage holding means connected to a corresponding second scanning signal line and a corresponding data signal line so as to hold an image signal voltage from the data signal line, a switching means which, with the use of a switching signal, switches between an output voltage of the first voltage holding means and that of the second voltage holding means so as to output a switched output voltage, and a pixel electrode connected to the switching means so as to apply the output voltage from the switching means to the liquid crystal.

This constitution also allows the flicker to be eliminated substantially.

In this constitution, it is preferable that the first voltage holding means should hold an image signal voltage with a positive polarity and the second voltage holding means should hold an image signal voltage with a negative polarity.

Furthermore, operation periods of the first voltage holding means and the second voltage holding means are made different from an operation period of the switching control means. This allows the flicker to be eliminated even further.

Also, it is desirable that the switching means should switch between the first voltage holding means and the second voltage holding means at least one time or more within one frame time period.

Also, a common electrode is formed on the other substrate of the pair of substrates, and a voltage, the polarity of which is opposite to that of the liquid crystal driving voltage applied to a pixel electrode in a pixel circuit, is caused to be applied to the common electrode. This makes it possible to lower the voltage applied to the pixel electrode in the pixel circuit, thus enabling the power consumption to be lowered.

The first voltage holding means constituted as above is further provided with a first switching element, a first capacitance element and a first buffer amplifier. The second voltage holding means constituted as above is further provided with a second switching element, a second capacitance element and a second buffer amplifier. In addition, the first switching element is constituted by a first P type transistor, and the second switching element is constituted by a first N type transistor. This makes it possible to employ transistors having a low withstanding voltage, thus enabling the power consumption to be lowered.

Also, it is desirable that the first buffer amplifier should be a voltage follower circuit constituted by a second N type transistor, and the second buffer amplifier should be a voltage follower circuit constituted by a second P type transistor.

If the transistors formed in the pixel circuit constituted as above are all N type transistors or P type transistors, it becomes possible to employ transistors having a low withstanding voltage. This enables the power consumption to be lowered.

In these constitutions of the liquid crystal display according to the present invention, first and second voltage holding circuits hold an image signal with a positive polarity and an image signal with a negative polarity, respectively. A switching circuit switches between the outputs from the voltage holding circuits, and the liquid crystal is driven using the switched output signal. This makes it unnecessary to cause a timing, with which the image signals are written into the first and the second voltage holding circuits, to coincide with a timing with which the liquid crystal is driven. As a result, in the liquid crystal display according to the present invention, by shortening a period of a control signal for the switching circuit, it is allowable to increase a frequency at which the liquid crystal is driven. This makes it possible to prevent the flicker. Also, it is possible to convert a drain signal into an alternating signal having two frame periods, thereby allowing the power consumption to be lowered. Moreover, by lengthening, as required, a period for writing the voltage into the voltage holding circuits, it is also possible to lower the power consumption.

Also, in the liquid crystal display according to the present invention, it is possible to drive the liquid crystal with the use of a voltage obtained by adding an alternating amplitude applied to the common electrode to the image signals held by the first and the second voltage holding circuits. On account of this, it is sufficient for the pixel circuit to generate an amplitude which has a positive or a negative polarity and is varied in correspondence with an image signal. This makes it possible to embody the pixel circuit with the use of transistors having a low withstanding voltage. For example, in the case of a 5V-driven liquid crystal, the liquid crystal driving voltage falls in a range of 2V to 5V in terms of the effective value, and thus a withstanding voltage of transistors used was required to be 10V or more even in an ideal case. In the liquid crystal display according to the present invention, however, it is possible to employ a method in which 2V, i.e. a minimum voltage for driving the liquid crystal, is applied from the common electrode and 3V, i.e. a variation amount of the voltage with a positive or a negative polarity, is controlled by the first and the second voltage holding circuits and the switching circuit. Accordingly, it is sufficient that, ideally, the withstanding voltage of the transistors used in the pixel circuit is equal to 3V or more. This makes it possible to lower a withstanding voltage which the transistors are required to have, thus eventually making it possible to lower the power consumption of the whole liquid crystal display.

DESCRIPTION OF THE PREFERRED EMBODIMENTS

Figure 1:
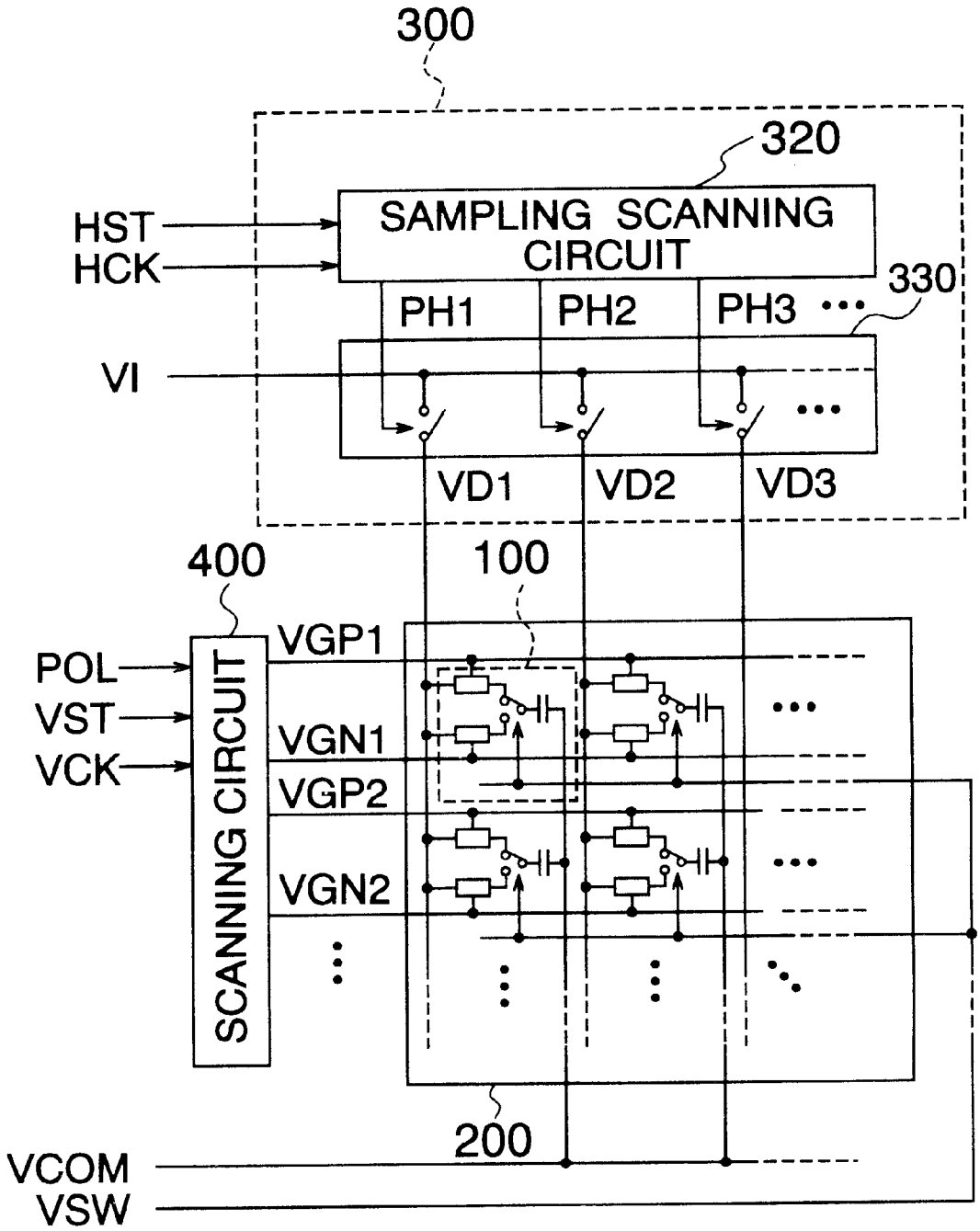
FIG. 1 is a block constitution diagram for showing a first embodiment of a liquid crystal display according to the present invention.

The detailed description will be given below concerning embodiments in the present invention. FIG. 1 shows a block constitution diagram of an embodiment of a liquid crystal display according to the present invention. In the liquid crystal display according to the present invention, a plurality of scanning signal lines and a plurality of data signal lines which are formed in a matrix-like structure with reference to the plurality of scanning signal lines are formed at least on one substrate, and pixels are constituted in domains surrounded by these interconnections, and a pixel circuit 100 is formed in each of the pixels. The pixel circuits 100 are located in a matrix-like structure, thereby forming a display unit 200. The above-mentioned data signal lines and scanning signal lines are connected to a signaling circuit 300 and a scanning circuit 400, which apply voltages to pixel electrodes formed in the pixel circuits.

The scanning circuit 400 inputs a polarity switching signal POL, a start signal VST and a clock signal VCK from outside the substrate, and supplies two kinds of scanning signals, i.e. VGP1, VGP2, . . . , and VGN1, VGN2, . . . , to row-direction of pixel circuits 100 located in the display unit 200.

The signaling circuit 300 comprises a sampling scanning circuit 320 and a sampling circuit 330, and supplies drain signals VD1, VD2, . . . to column-direction of pixel circuits 100 located in the display unit 200. The sampling scanning circuit 320 inputs a start signal HST and a clock signal HCK, and outputs sampling signals PHi, PH2, . . . . The sampling circuit 330 inputs the sampling signals PHi, PH2, . . . and an image signal VI, and generates the drain signals VD1, VD2, . . .

Figure 2:
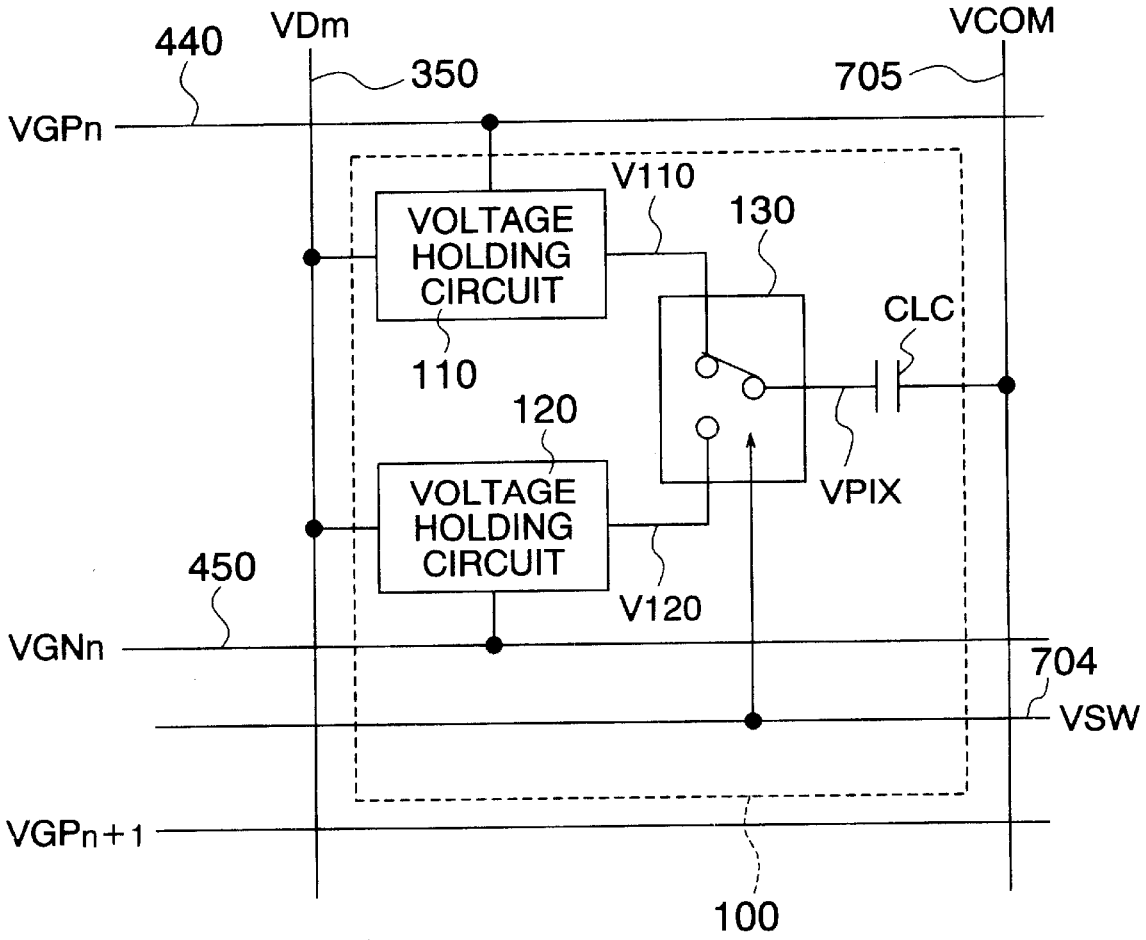
FIG. 2 is a block constitution diagram for showing a pixel circuit of the first embodiment in the present invention.

FIG. 2 shows a block constitution diagram of the pixel circuit 100 of the embodiment in the present invention.

The pixel circuit 100 comprises a first voltage holding circuit 110 connected to a first scanning signal line and a data signal line so as to always hold an image signal voltage with a positive polarity, a second voltage holding circuit 120 connected to a second scanning signal line and the data signal line so as to always hold an image signal voltage with a negative polarity, a signal switching circuit 130, and a pixel electrode which sandwiches liquid crystal CLC and is connected thereto. The first voltage holding circuit 110 inputs a scanning signal VGPn and a drain signal VDm, and outputs an output thereof V110 to the signal switching circuit 130. Also, the second voltage holding circuit 120 inputs a scanning signal VGNn and the drain signal VDm, and outputs an output thereof V120 to the signal switching circuit 130. The signal switching circuit 130 inputs the above-described outputs V110, V120 and a switching control signal VSW, and connects an output thereof VPIX with the pixel electrode not illustrated. The liquid crystal CLC is connected between the pixel electrode and a common electrode VCOM formed on a substrate opposed to the above-described substrate.

Figure 3:
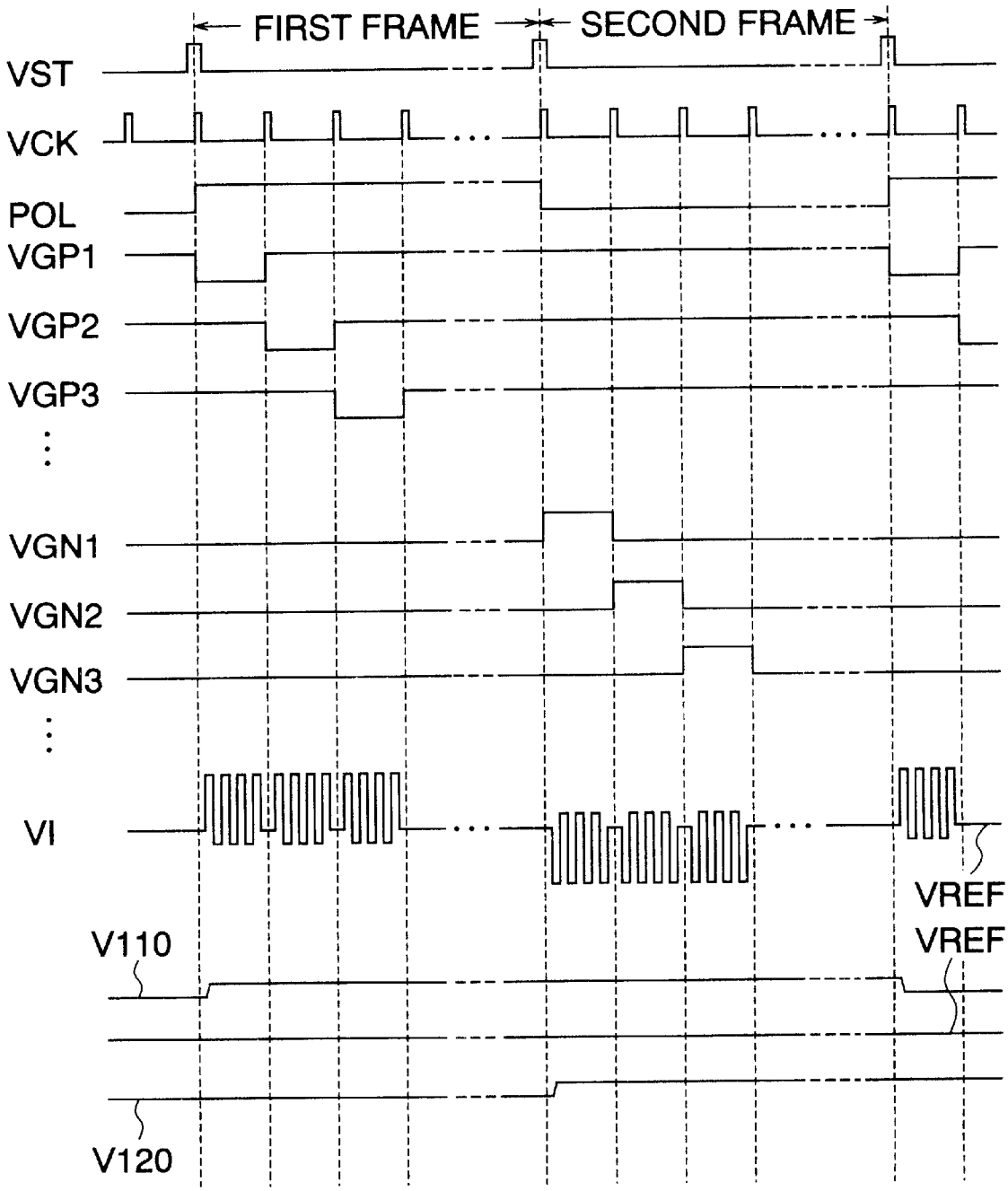
FIG. 3 is a timing chart for showing an operation of the first embodiment in the present invention.
Figure 4:
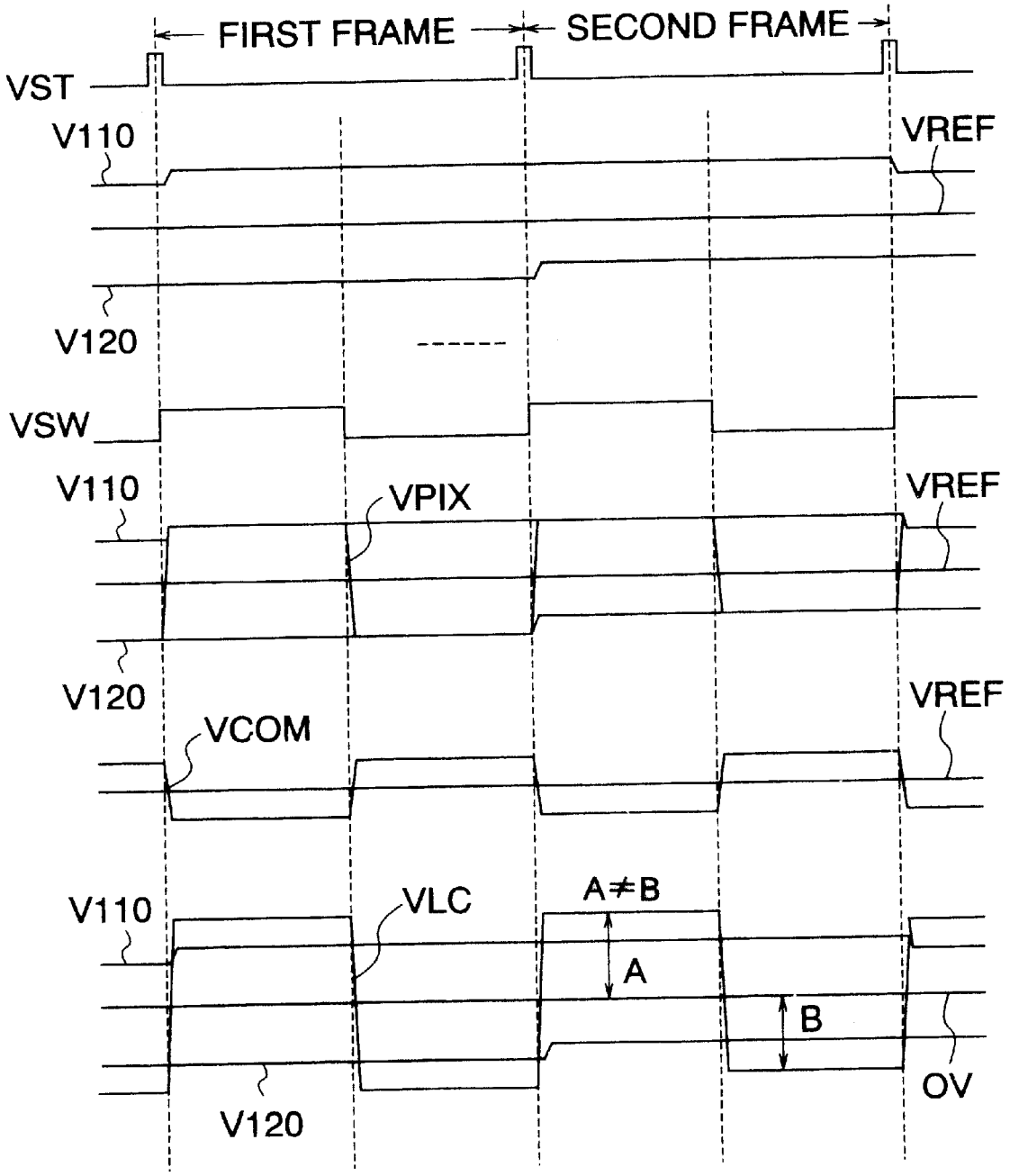
FIG. 4 is a timing chart for showing an operation of the first embodiment in the present invention.

Under the constitution as presented above, a voltage is applied with a signal voltage applying (operating) timing of the present invention illustrated in FIGS. 3 and 4. A start signal VST, which is an input signal in FIG. 3, indicates head of a frame of an image to be displayed. A clock signal VCK, which is an input signal as well, indicates a switching timing of a scanning signal. The above-described scanning circuit 400 grabs the above-described start signal VST with a timing of a rising edge of the above-described clock signal VCK, and outputs the above-described scanning signals VGP1, VGP2, . . . and VGN1, VGN2, . . . . Here, the scanning signals VGP1, VGP2, . . . are designated by negative scanning signals, and the scanning signals VGN1, VGN2, . . . are designated by positive scanning signals. The scanning signals VGP1, VGP2, . . . and the scanning signals VGN1, VGN2, . . . are outputted alternately to each other for every frames.

An image signal VI is varied with a reference voltage VREF as the reference, and is separated into signals one of which is equivalent to an amount of the image to be displayed by a single row. The polarity of the image signal is inverted every one frame. V110, V120 respectively mean outputs of the first and second voltage holding circuits 110, 120 in the pixel circuit 100 when the driving is performed under the above-mentioned conditions. The pixel circuit 100 is illustrated by assuming, as its position, a position of one row and one column corresponding to an upper-left corner in the display unit 200. Here, the first voltage holding circuit 110, when the scanning signal VGP1 is "L", performs sampling of the drain signal VD1, i.e. an output of the signaling circuit 300, and holds the voltage when the scanning signal VGP1 is "H". The second voltage holding circuit 120, when the scanning signal VGN1 is "H", performs sampling of the drain signal VD1, i.e. an output of the signaling circuit 300, and holds the voltage when the scanning signal VGN1 is "L". The drain signal VD1, although not illustrated in the timing chart, is generated by, as described earlier, performing sampling of the image signal VI. Accordingly, the polarity thereof coincides with that of the image signal VI. As a result, the first voltage holding circuit 110, when the scanning signal VGP1 is "L", performs sampling of an image signal VI with a positive polarity, and the second voltage holding circuit 120, when the scanning signal VGN1 is "L", performs sampling of an image signal VI with a negative polarity (In FIG. 3, the image signal VI with a positive or a negative polarity is an image signal voltage at the time when an image is divided into several portions and is then colored in a striped manner.). Consequently, a polarity of V110, i.e. the output of the first voltage holding circuit 110, always becomes positive, and a polarity of V120, i.e. the output of the second voltage holding circuit 120, always remains negative.

Next, using a timing chart in FIG. 4, the description will be given below concerning an operation of the signal switching circuit 130. A start signal VST and V110, V120, i.e. outputs of the first and second voltage holding circuits 110, 120, are illustrated under the same conditions as those for the timing illustrated in FIG. 3.

A voltage is an output of t he signal switching circuit 130. The signal switching circuit 130 generates VPIX by switching between the output with a positive polarity, i.e. V110, and the output with a negative polarity, i.e. V120, with the use of a switching control signal VSW. A voltage VCOM is varied with the above-mentioned reference voltage VREF as the reference, and a timing for the variation thereof is caused to coincide with a timing for the variation of the switching control signal VSW. A voltage VLC is a voltage for driving the liquid crystal CLC. The voltage VLC becomes equal to a difference between the output of the signal switching circuit 130, i.e. VPIX, and the voltage for the common electrode, i.e. VCOM. The voltage for the common electrode, i.e. VCOM, is applied with an amplitude the polarity of which is opposite to that of the output of the signal switching circuit 130, i.e. VPIX. This makes it possible to drive the liquid crystal with the use of an amplitude obtained by adding the amplitude of the voltage for the common electrode, i.e. VCOM, to an amplitude of the output of the signal switching circuit 130, i.e. VPIX.

As described above, in the liquid crystal display according to the present invention, the first and second voltage holding circuits hold an image signal with a positive polarity and an image signal with a negative polarity. The switching circuit alternately switches between the outputs from the voltage holding circuits, thereby driving the liquid crystal. This makes it unnecessary to cause a timing, with which the image signals are written into the first and the second voltage holding circuits, to coincide with a timing with which the liquid crystal is driven.

Namely, according to the present invention, it is possible to freely determine a period of a control signal for the switching circuit. This makes it possible to increase a frequency at which the liquid crystal is driven, thus allowing the flicker to be prevented.

Also, when there is no extreme and intense change in an image being displayed, the scanning circuit is provided with a means for varying the frequency. This transaction makes it possible to lengthen a period for writing the voltage into the first and the second voltage holding circuits (when trying to suppress the flicker to a certain extent) with the same frame frequency as that in the prior art. On account of this, it becomes possible to lower, as compared with 30 Hz in the prior art, a frequency which is obtained when the drain signal itself is converted into an alternating signal.

Allowing a frame frequency to be lowered means, for example, allowing the power consumption to be lowered.

Furthermore, in the liquid crystal display according to the present invention, it is possible to drive the liquid crystal with the use of a voltage obtained by adding an alternating amplitude applied to the common electrode to the image signals held by the first and the second voltage holding circuits. On account of this, it is sufficient for the pixel circuit to generate an amplitude which has a positive or a negative polarity and is varied in correspondence with an image signal. This makes it possible to embody the pixel circuit with the use of transistors having a low withstanding voltage. For example, in the case of a 5V-driven liquid crystal, the liquid crystal driving voltage falls in a range of 2V to 5V in terms of the effective value, and thus a withstanding voltage of transistors used was required to be 10V or more even in an ideal case.

In the present invention, however, it is possible to employ a method in which 2V, i.e. a minimum voltage for driving the liquid crystal, is applied from the common electrode and 3V, i.e. a variation amount of the voltage with a positive or a negative polarity, is controlled by the first and the second voltage holding circuits and the switching circuit. Accordingly, it is sufficient that, ideally, the withstanding voltage of the transistors used in the pixel circuit is equal to 3V or more.

Speaking of a condition for the withstanding voltage, even a transistor the withstanding voltage of which is presented by the following expression becomes usable: (a maximum value of a signal voltage+an amplitude of a voltage applied to the common electrode×2−a minimum value of the signal voltage)/2. This means that it is possible to lower the withstanding voltage tremendously.

Lowering the withstanding voltage of the transistors brings about the following secondary effects: an increase in the aperture ratio due to miniaturization of the transistors, an enhancement in reliability of the transistors, a reduction in the power consumption, a decrease in the unnecessary radiation noise, and so on.

Figure 5:
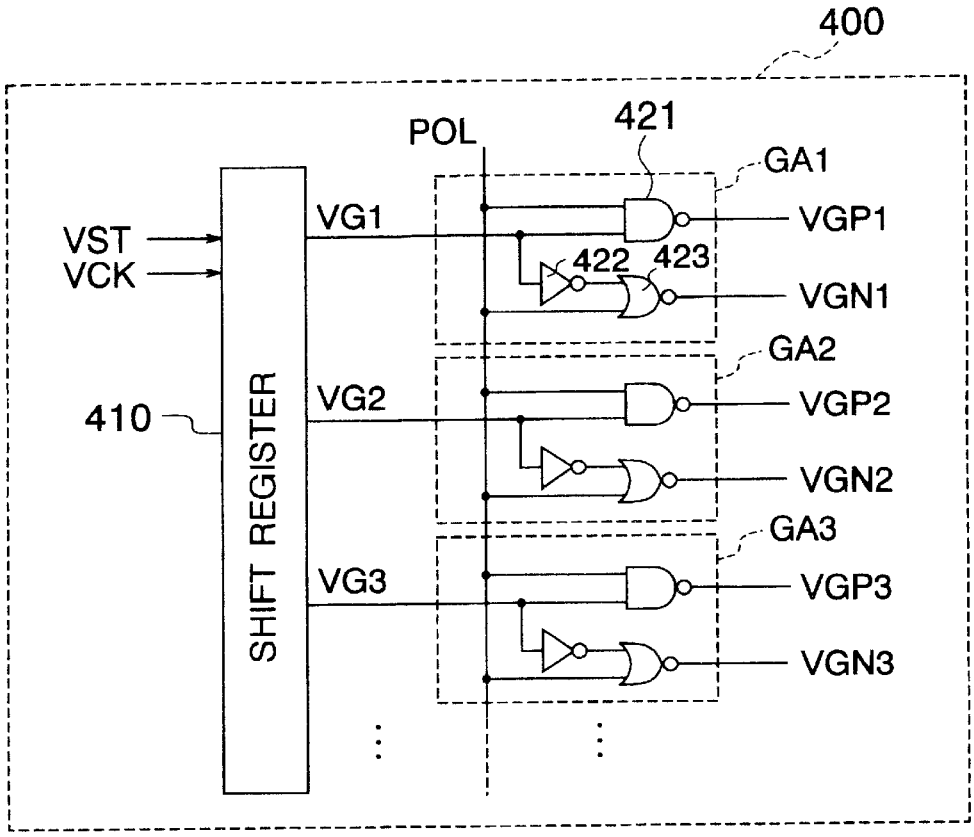
FIG. 5 is a block diagram for showing a constitution of a scanning circuit of the first embodiment in the present invention.

FIG. 5 shows an embodiment of the scanning circuit 400 applied to the liquid crystal display in the present invention. The scanning circuit 400 comprises a shift register 410 and a plurality of gate circuits GA1, GA2, . . . The shift register 410 inputs a start signal VST and a clock signal VCK, and generates a plurality of outputs VG1, VG2, . . . The plurality of gate circuits GA1, GA2, . . . comprise NAND gates 421, inverters 422 and NOR gates 423. Each of the gate circuits inputs an output of the shift register 410 and a polarity signal POL, and generates two kinds of scanning signals, i.e. VGPn and VGNn.

Figure 6:
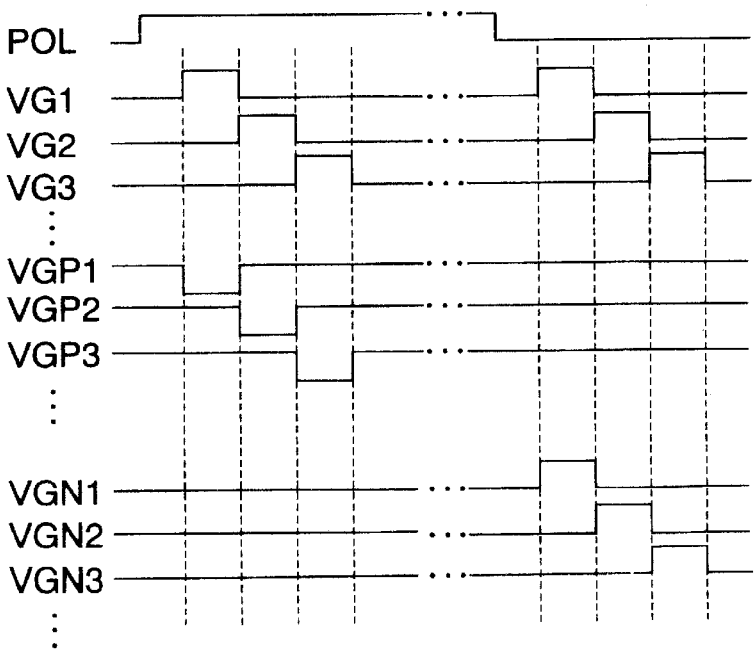
FIG. 6 is a timing chart for showing an operation of the scanning circuit of the first embodiment in the present invention.

Using FIG. 6, the description will be given below concerning an operation of the scanning circuit illustrated in FIG. 5. The outputs of the shift register 410, i.e. VG1, VG2, . . . are multiphase signals which, as illustrated, are not overlapped with each other. The outputs of the gate circuits, i.e. VGP1, VGP2, . . . are generated by NAND logic consisting of the outputs of the shift register and the polarity signal POL. Consequently, the outputs of the gate circuits, i.e. VGP1, VGP2, . . . , as illustrated, become negative scanning signals when the polarity signal POL is "H" and become "H " fixed when the polarity signal POL is "L". Meanwhile, the outputs of the gate circuits, i.e. VGN1, VGN2, . . . are generated by NOR logic consisting of inverted signals of the outputs of the shift register and the polarity signal POL. Consequently, the outputs of the gate circuits, i.e. VGN1, VGN2, . . . , as illustrated, become positive scanning signals when the polarity signal POL is "L", and become "L" fixed when the polarity signal POL is "H".

Figure 7:
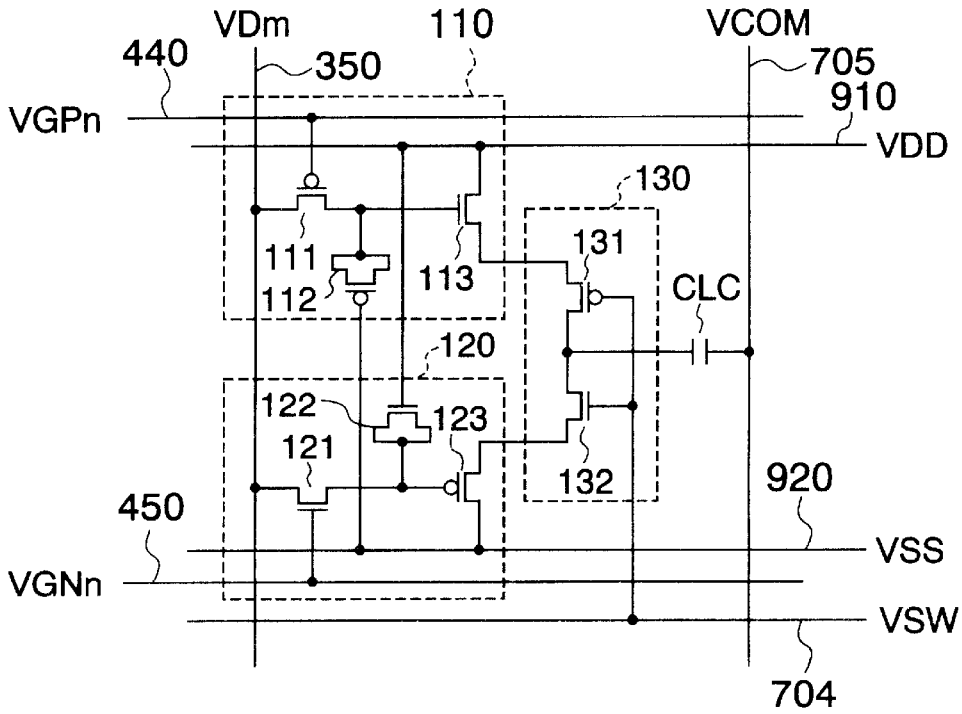
FIG. 7 is a circuit constitution diagram for showing a first embodiment of the pixel circuit in the present invention.

FIG. 7 shows a first embodiment of the pixel circuit in the present invention. The present embodiment employs an example in which Thin-Film Transistors (TFT) employing poly crystal silicon are used. Components corresponding to those in the block diagram illustrated in FIG. 2 are denoted using the same reference numerals.

A first voltage holding circuit 110 comprises a P type TFT 111, a N type TFT 113, and a capacitor 112. A gate of the TFT 111 is connected to a scanning signal VGPn, a drain thereof to a drain signal VDm, and a source thereof to the capacitor 112 and a gate of the TFT 113. The other end of the capacitor 112 is connected to VSS, and a drain of the TFT 113 is connected to a power supply VDD, and a source thereof to the signal switching circuit 130.

The description will be given below concerning an operation of the first voltage holding circuit 110 constituted as above. The TFT 111, when the scanning signal VGPn is "L", is switched to ON state and writes the drain signal VDm into the capacitor 112, and when the scanning signal VGPn is "H", the TFT 111 is switched to OFF state and holds the voltage written into the capacitor 112. The TFT 113 operates as a voltage follower circuit, and outputs the voltage, which is written into the capacitor 112 and held therein, to the signal switching circuit 130. A source voltage of the TFT 113 becomes equal to a value which is lower than the voltage held in the capacitor 112 by an amount of Vth, i.e. a threshold voltage of the TFT 113.

A second voltage holding circuit 120 comprises a N type TFT 121, a P type TFT 123, and a capacitor 122. The constitution thereof is antisymmetric to the first voltage holding circuit 110 in the type of the TFTs. The TFT 121, when the scanning signal VGNn is "H", is switched to ON state and writes the drain signal VDm into the capacitor 122, and when the scanning signal VGNn is "L", the TFT 121 is switched to OFF state and holds the voltage written into the capacitor 122. The TFT 123 operates as a voltage follower circuit, and outputs the voltage, which is written into the capacitor 122 and held therein, to the signal switching circuit 130. A source voltage of the TFT 123 becomes equal to a value which is lower than the voltage held in the capacitor 122 by an amount of Vth, i.e. a threshold voltage of the TFT 123.

The signal switching circuit 130 comprises a P type TFT 131 and a N type TFT 132. A gate of each of the TFTs is connected to a switching control signal VSW, a source of each of the TFTs is connected to liquid crystal CLC through a pixel electrode not illustrated, and drains of the TFT 131 and the TFT 132 are connected to drains of the above-described TFT 113 and TFT 123, respectively. When the switching control signal VSW is "L" and then the TFT 131 is switched to ON state, the signal switching circuit 130 constituted as above supplies an output of the first voltage holding circuit 110 to the liquid crystal CLC. Meanwhile, when the switching control signal VSW is "H" and then the TFT 132 is switched to ON state, the signal switching circuit 130 supplies an output of the second voltage holding circuit 120 to the liquid crystal CLC.

As described above, in the liquid crystal display according to the present invention, the first and the second voltage holding circuits are provided with the TFTs which operate as voltage follower circuits. On account of this, it turns out that the liquid crystal CLC is always allowed to be driven at a low impedance. Accordingly, it becomes possible to employ even a liquid crystal which has only a low impedance. This is specially effective when employing a liquid crystal having a comparatively low impedance such as, for example, guest host.

Figure 8:
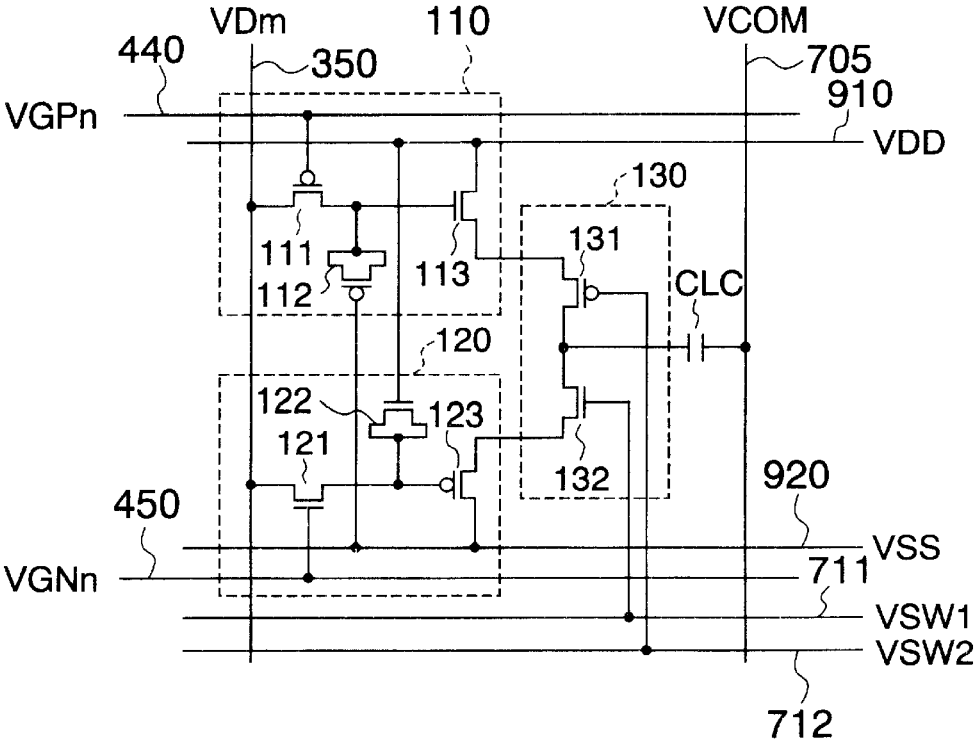
FIG. 8 is a circuit constitution diagram for showing a second embodiment of the pixel circuit in the present invention.

FIG. 8 shows a second embodiment of the pixel circuit in the present invention. The same components as those in the embodiment illustrated in FIG. 7 are denoted using the same reference numerals. What is different from the embodiment in FIG. 7 is that the switching control signal VSW is divided into VSW1 and VSW2 and a gate of the P type TFT 131 is connected to VSW2 and a gate of the N type TFT 132 is connected to VSW1. In the embodiment in FIG. 7, when the switching control signal VSW is changed, both the TFT 131 and the TFT 132 are switched to ON state transiently. This permits a penetrating electric current to pass through the TFT 113, the TFT 131, the TFT 132 and the TFT 123, thus increasing the power consumption. In the embodiment in FIG. 8, gates voltages of the TFT 131 and the TFT 132 are controlled independently of each other, thereby making it possible to avoid the TFT 131 and the TFT 132 from being switched to ON state simultaneously.

Figure 9:
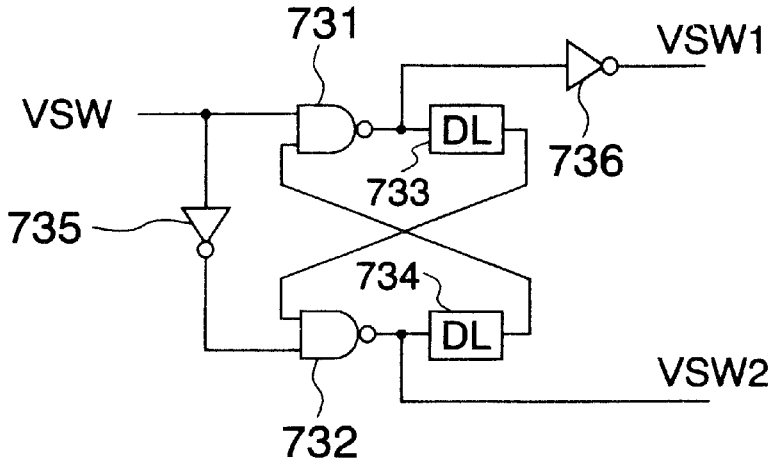
FIG. 9 is a circuit constitution diagram of a switching signal generating circuit for controlling the second embodiment of the pixel circuit in the present invention.
Figure 10:
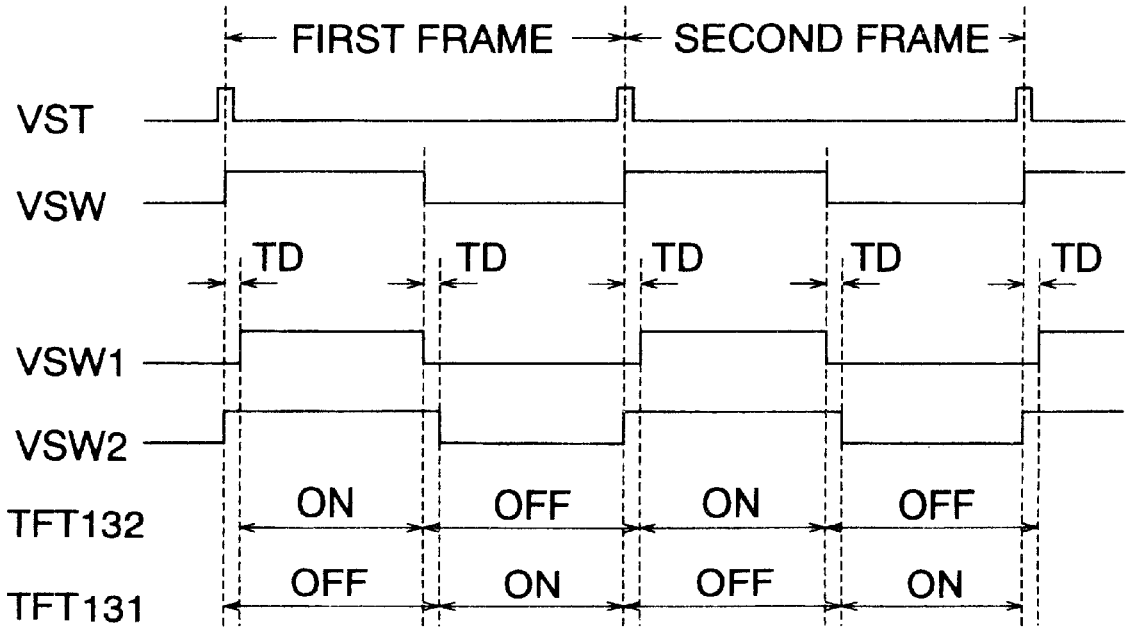
FIG. 10 is a timing chart for showing an operation of the switching signal generating circuit applied to the present invention.

FIGS. 9 and 10 show a circuit constitution diagram and a timing chart of a generating circuit of the switching control signals VSW1, VSW2. The switching signal generating circuit inputs the switching control signal VSW and outputs the switching control signals VSW1, VSW2. The generating circuit comprises NAND gates 731, 732, inverters 735, 736, and delay elements 733, 734.

FIG. 10 shows a timing of an operation of the generating circuit. Together with the switching control signals VSW1, VSW2, states of the transistors controlled by the signals are described. As seen from FIG. 10, states of both the TFT 131 and the TFT 132 are varied while passing steps of the OFF states. This prevents the penetrating electric current from passing through the transistors, thus making it possible to reduce the power consumption.

Figure 11:
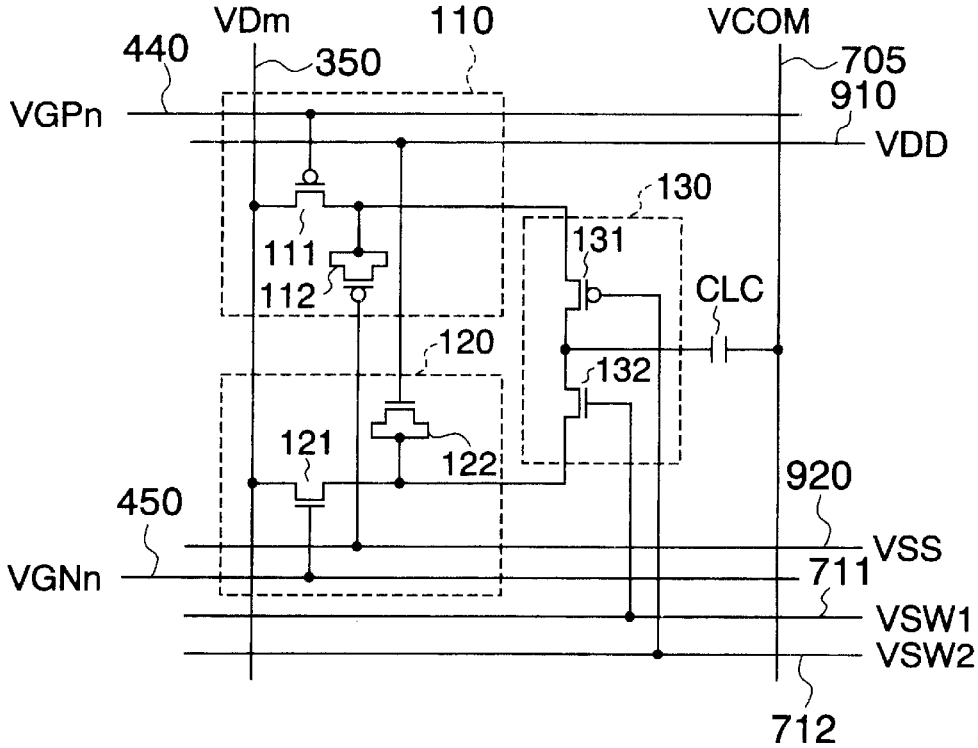
FIG. 11 is a circuit constitution diagram for showing a third embodiment of the pixel circuit in the present invention.

FIG. 11 shows a third embodiment of the pixel circuit in the present invention. What is different from the second embodiment illustrated in FIG. 8 is that output terminals of the first and the second voltage holding circuits 110, 120 are sources of the N type TFT 111 and the P type TFT 121, respectively. Namely, in the present embodiment, instead of providing the voltage follower circuits installed in the embodiment in FIG. 8, capacitances of the capacitors 112, 122, which are included in the first and the second voltage holding circuits 110, 120, are made large enough as compared with a capacitance of the liquid crystal CLC, thereby making it possible to obtain an effect similar to the one obtained by the embodiment in FIG. 8. Also, in the present embodiment, all of the TFTs constituting the pixel circuit 100 operate as switches. This brings about an effect that the pixel circuit 100 becomes more resistant to influences exerted by threshold voltages of the TFTs.

Figure 12:
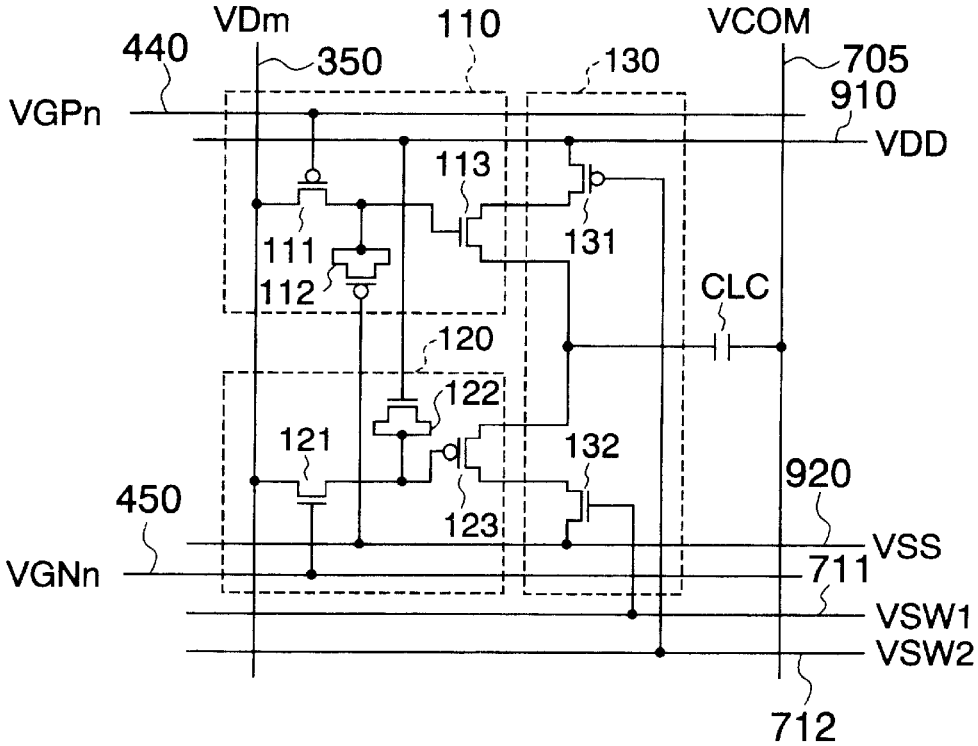
FIG. 12 is a circuit constitution diagram for showing a fourth embodiment of the pixel circuit in the present invention.

FIG. 12 shows a fourth embodiment of the pixel circuit in the present invention. What is different from the embodiment illustrated in FIG. 8 is a connecting method of sources and drains of the TFT 131 and the TFT 132 which constitute the signal switching circuit 130. In the present embodiment, the TFT 131 is connected between the power supply VDD and the TFT 113, and the TFT 132 is connected between the TFT 123 and the power supply VSS. In the present embodiment, too, it is possible to switch between outputs of the first and the second voltage holding circuits. This brings about an effect similar to the one obtained by the embodiment in FIG. 8.

Figure 13:
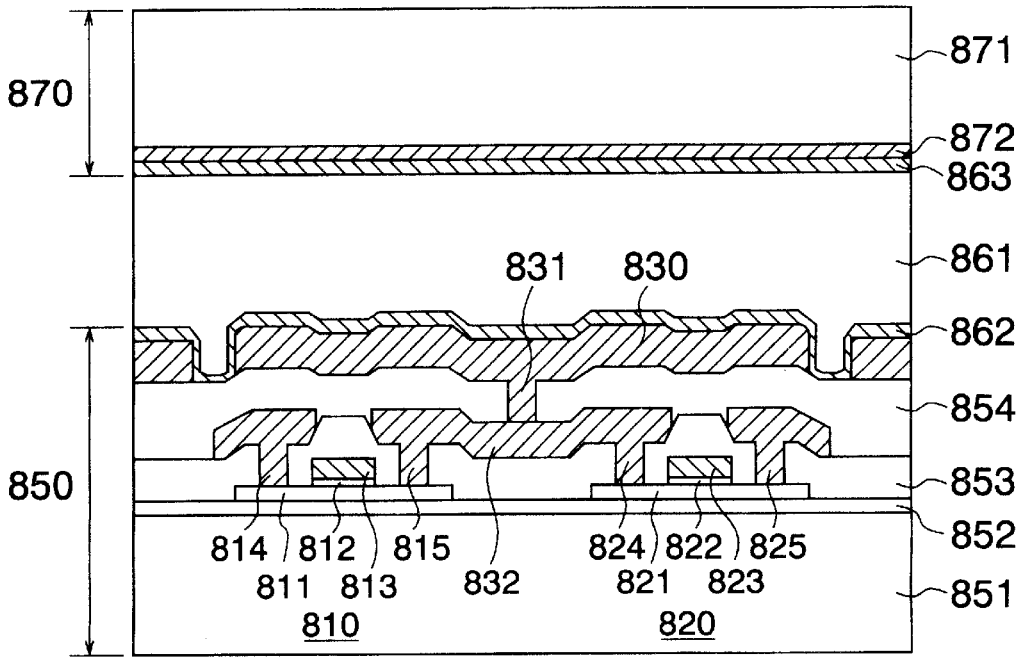
FIG. 13 is a cross sectional construction diagram corresponding to the first embodiment of the pixel circuit in the present invention.

FIG. 13 shows an example of a cross sectional construction of the display unit in the liquid crystal display according to the present invention. The constitution of the display unit is such that a liquid crystal layer 861 is held by a TFT substrate 850 and an opposing substrate 870 in such a manner as to be sandwiched therebetween. The construction of the TFT substrate 850 is formed as follows: A TFT 810 and a TFT 820 are formed over a glass substrate 851 on which an oxide film 852 is formed, and, using a first metal interconnection layer 832, a drain and a source of each of the TFTs are connected so as to form the required circuit. Then, a portion thereof, by way of a through hole 831, is connected to a second metal interconnection layer 830, i.e. a pixel electrode, and an alignment layer 862 is coated on the pixel electrode, thus forming the construction.

Here, the construction of the TFT 810 is such that a gate electrode 813 is formed over a poly silicon layer 811 with a gate oxide film 812 sandwiched therebetween, and then an oxide film 853 is formed on the gate electrode 813. A source electrode and a drain electrode are extracted through contacts 814, 815 with the use of the first metal interconnection layer 832. The TFT 820 is of the same construction. Here, the question as to whether each of the TFTs is a N type or a P type transistor is determined by a N type or a P type impurity with which a drain region and a source region of each of the TFTs are doped.

Meanwhile, the construction of the opposing substrate 870 is such that an orientation film 863 is coated over a glass substrate 871 on which a transparent electrode 872 is formed.

Figure 14:
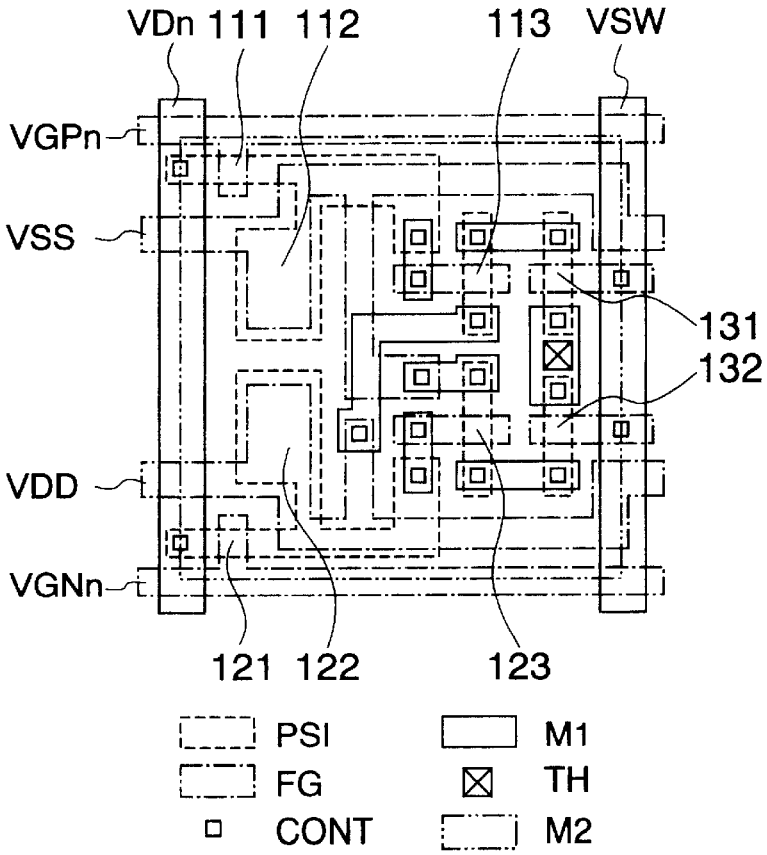
FIG. 14 is an embodiment of a layout diagram corresponding to the first embodiment of the pixel circuit in the present invention.

FIG. 14 shows a layout diagram of the pixel circuit in the present invention. Here, the diagram is illustrated concerning representative patterns for forming the TFT substrate 850, i.e. a poly silicon layer PSI, a gate layer FG, a contact layer CONT, first and second metal interconnection layers M1, M2, and a through hole TH.

The description will be given below concerning a relationship between each of the layout layers and the cross sectional construction, using contrast between FIG. 14 and FIG. 13. The poly silicon layer PSI designates a region of the poly silicon layer 811 of the TFT, and the gate layer FG designates a region of the gate electrode 813 of the TFT and a region of gate interconnections not illustrated. The contact layer CONT designates connection portions between the poly silicon layer 811 and the first metal interconnection layer 832, which are represented by the contacts 814, 815, and connection portions between the gate interconnections not illustrated and the first metal interconnection layer. The first and the second metal interconnection layers Ml, M2 designate the first and the second metal interconnection layers denoted by reference numerals 832, 830. The through hole TH is a region denoted by reference numeral 831 and connecting the first and the second metal interconnection layers.

In FIG. 14, two kinds of scanning signals VGPn, VGNn and positive and negative power supply lines VDD, VSS employ the gate interconnection layer FG. A drain data signal line VDn and a switching control signal line VSW employ the first metal interconnection layer Ml. Portions corresponding to the TFT elements in the pixel circuit illustrated in FIG. 7 are denoted using the same reference numerals. It is understood that the layout constitution shown in FIG. 14 makes it possible to embody the first embodiment of the pixel circuit.

Figure 15:
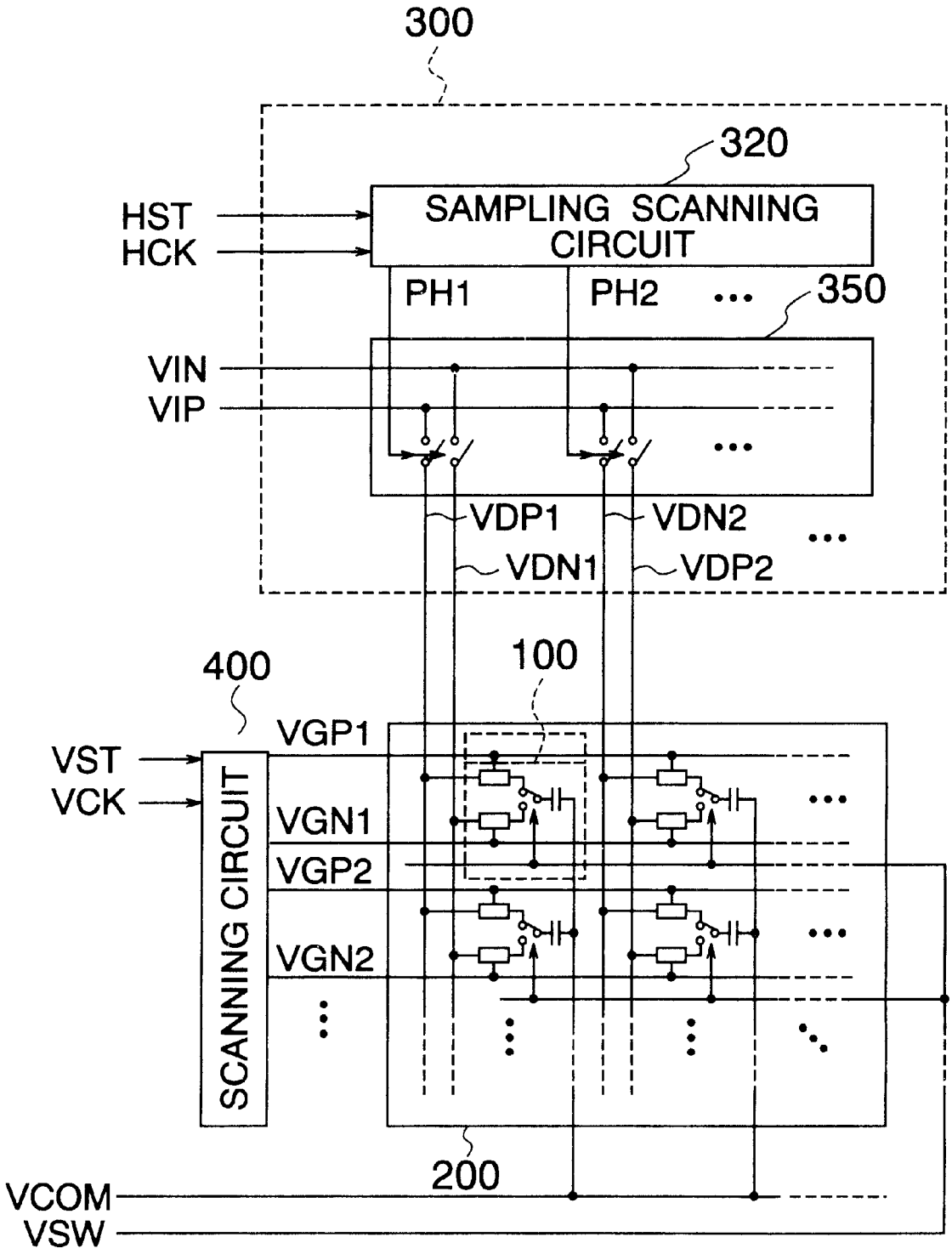
FIG. 15 is a block constitution diagram for showing a second embodiment of a liquid crystal display according to the present invention.

FIG. 15 shows a block constitution diagram of a second embodiment of the liquid crystal display in the present invention. In the present embodiment, the same components as those in the embodiment illustrated in FIG. 1 are denoted using the same reference numerals. What is different from the embodiment in FIG. 1 is the following two points: The signaling circuit 300 simultaneously outputs drain signals with a positive polarity VDP1, VDP2, . . . and drain signals with a negative polarity VDN1, VDN2, . . . , and the pixel circuit 100 inputs the drain signals with a positive polarity VDP1, VDP2, . . . and the drain signals with a negative polarity VDN1, VDN2, . . .

Figure 16:
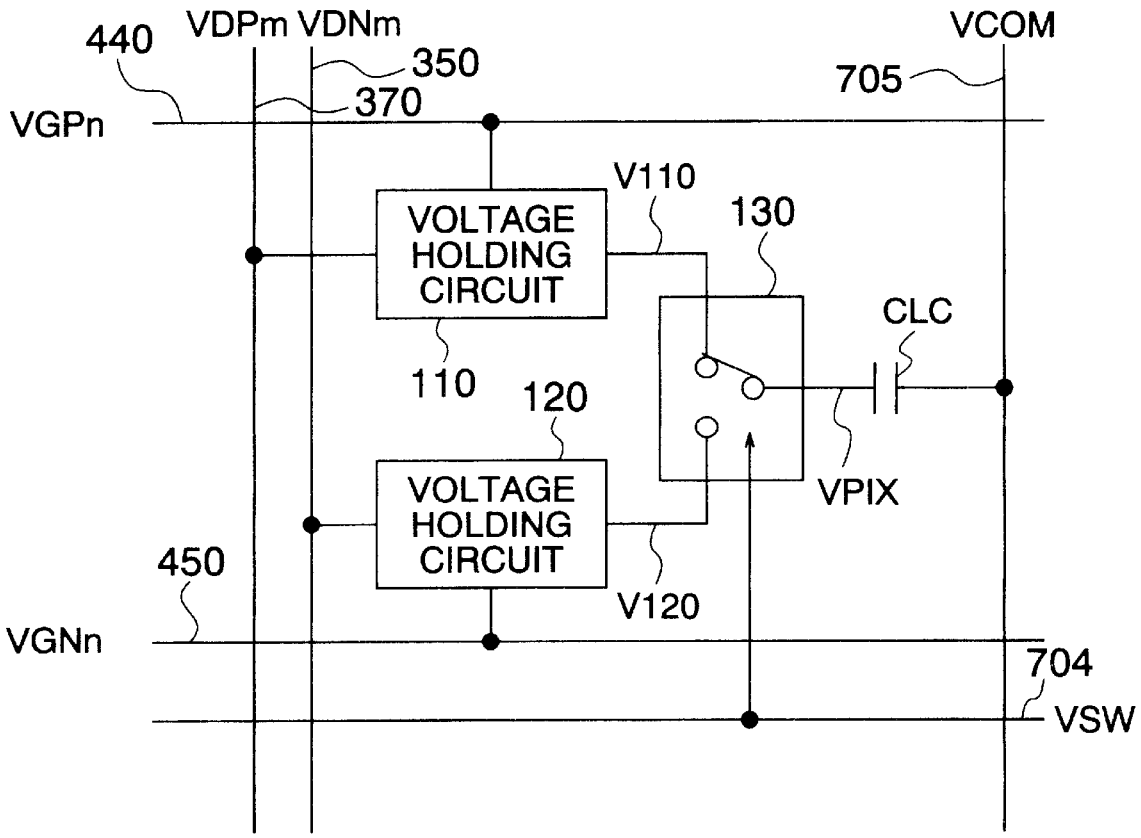
FIG. 16 is a block constitution diagram for showing a pixel circuit of the second embodiment in the present invention.

FIG. 16 shows a block constitution diagram of a pixel circuit of the second embodiment of the liquid crystal display in the present invention. The first voltage holding circuit 110 is connected to the drain signal with a positive polarity VDPm, and the second voltage holding circuit 120 is connected to the drain signal with a negative polarity VDNm.

Figure 17:
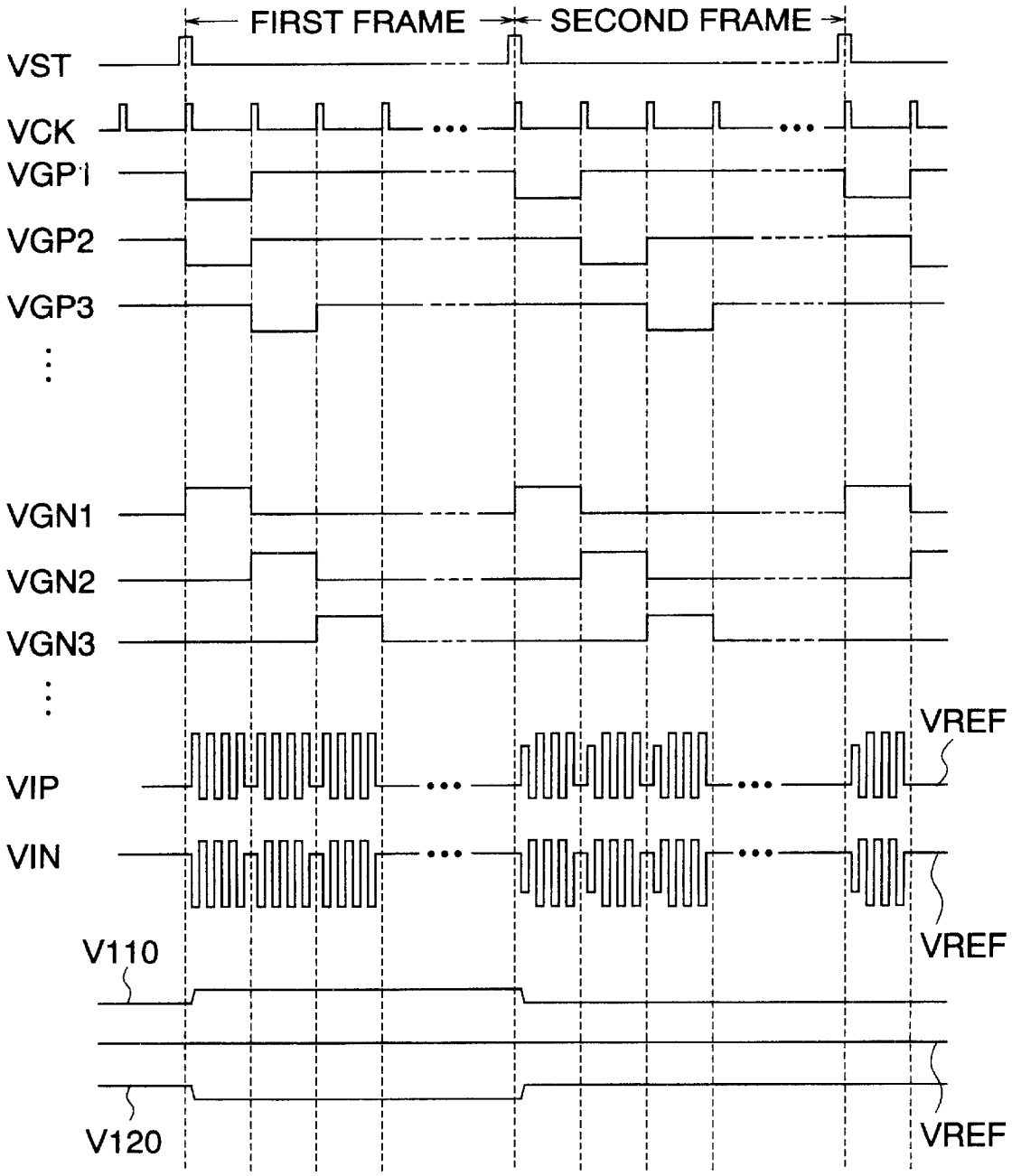
FIG. 17 is a timing chart for showing an operation of the second embodiment in the present invention.
Figure 18:
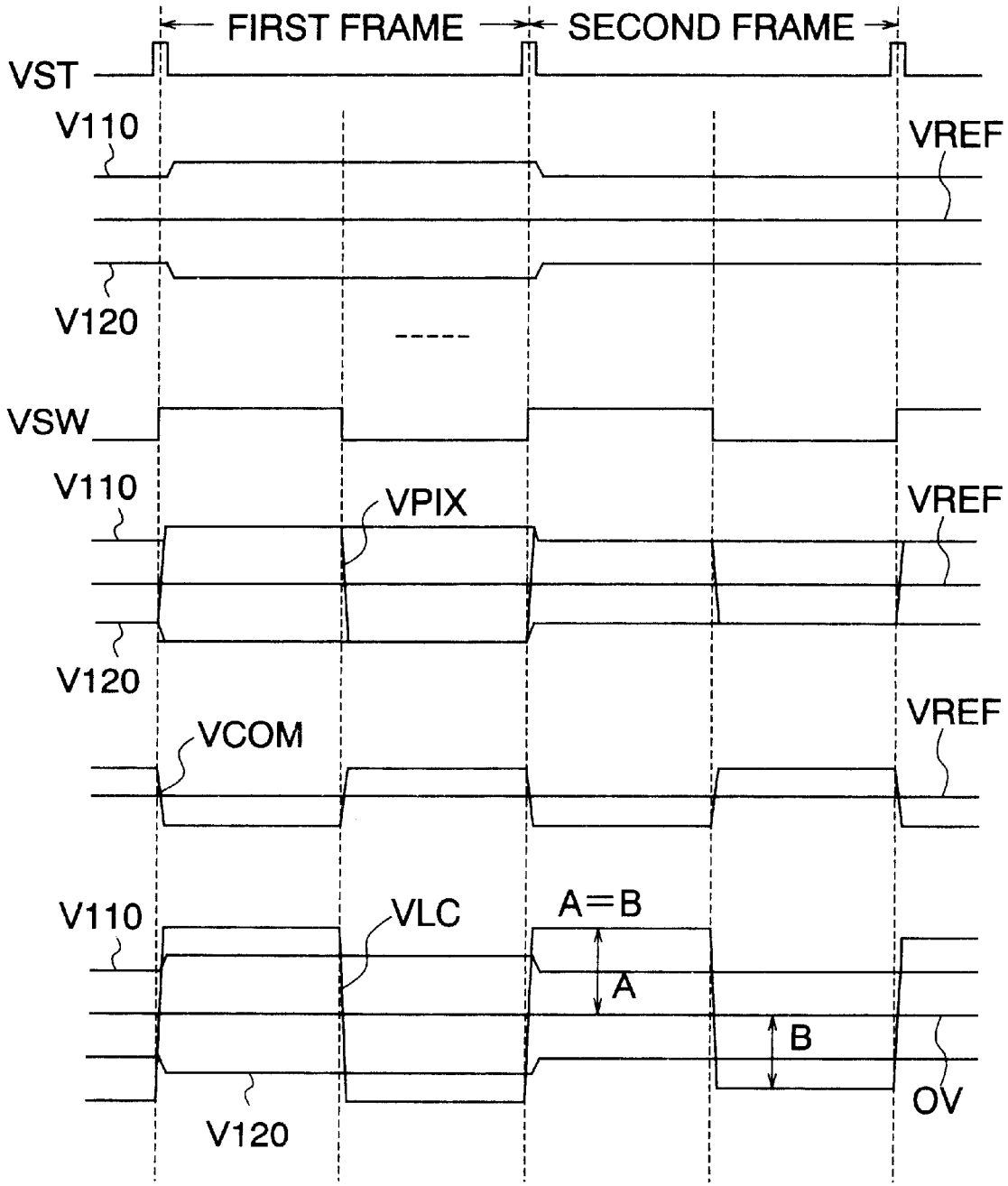
FIG. 18 is a timing chart for showing an operation of the second embodiment in the present invention.

The description will be given below concerning an operation of the above-constituted second embodiment of the liquid crystal display in the present invention, using timing charts illustrated in FIGS. 17, 18. In the timing chart in FIG. 17, what is different from the timing chart in FIG. 3 is the following two points: First, both of the scanning signals, i.e. the scanning signals with a positive polarity VGP1, VGP2, . . . and those with a negative polarity VGN1, VGN2, . . . , are outputted simultaneously for every one frame. Second, an image signal with a positive polarity VIP and an image signal with a negative polarity VIN, i.e. image signals for an image which generate the drain signals from the signaling circuit. These two points, which are different from the timing chart in FIG. 3, permit, for every one frame, the image signals to be written into and held in the first and the second voltage holding circuits 110, 120. This further allows an output of each voltage holding circuit to generate a voltage which is always symmetrical toward the reference voltage. As a result, even in a state in which the image signals are varied as illustrated in FIG. 18, an amplitude with a positive polarity A and an amplitude with a negative polarity B become equal to each other. This makes it possible to prevent, even in a transient state, an increase in the flicker or a deterioration in the liquid crystal element due to application of a direct current to the liquid crystal.

Figure 19:
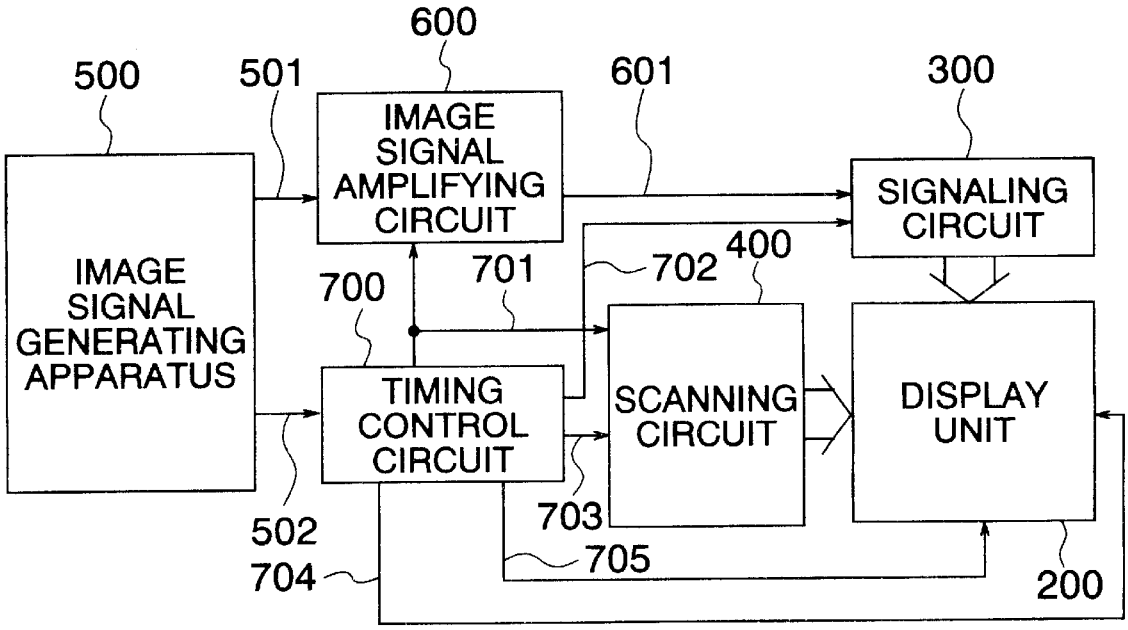
FIG. 19 shows an example of a system constitution of a liquid crystal display to which the present invention is applied.

FIG. 19 shows an example of a system constitution of the liquid crystal display according to the present invention. The present system is constituted so that the display unit 200, the signaling circuit 300 and the scanning circuit 400 are driven by an image signal generating apparatus 500, an image signal amplifying circuit 600 and a timing control circuit 700. The image signal generating apparatus 500 outputs an image signal 501 and a synchronizing signal 502 to the image signal amplifying circuit 600 and the timing control circuit 700. The timing control circuit 700 inputs the synchronizing signal 502, and generates a polarity signal 701, a control signal 702 for the signaling circuit, a control signal 703 for the scanning circuit, a switching signal 704, and a control signal 705 for the common electrode. Also, the image signal amplifying circuit 600 inputs the image signal 501 and the polarity signal 701, and generates an image signal 601 which is converted into an alternating signal.

In the constitution described above and the constitution in FIG. 1, a period of the synchronizing signal is delayed, thereby making it possible to decrease a frame frequency of the image signal. This allows the power consumption to be lowered.

Incidentally, although the embodiments in the present invention are described using an example in which the TFTs are employed, employing MOS transistors with a single crystal silicon also makes it possible to obtain the same effects as those in the example.

Also, although, in the embodiments in the present invention, the driving system for the data signal lines is described using the point-sequence system, the driving system is also applicable to a line-sequence system in which a voltage of each data signal line is controlled with an identical timing.

The present invention makes it possible to provide a liquid crystal display which produces no flicker.

What is claimed is:

1. A liquid crystal display comprising:

a pair of substrates;

a liquid crystal layer held by the pair of substrates in such a manner as to be sandwiched therebetween;

a plurality of scanning signal lines formed on one substrate of the pair of substrates; and a plurality of data signal lines formed on the one substrate in a matrix-like structure with reference to the plurality of scanning signal lines;

wherein a plurality of pixels are constituted in domains surrounded by the plurality of scanning signal lines and the plurality of data signal lines; and wherein a pixel circuit for applying a liquid crystal driving voltage to the liquid crystal layer is formed in each of the pixels, the pixel circuit applying, to the liquid crystal layer, at least one period of a liquid crystal driving voltage which has a different polarity for every one frame, the pixel circuit including first storing means for storing a liquid crystal driving voltage for a present frame, second storing means for storing a liquid crystal driving voltage for a one-preceding frame, and switching means for switching between the first storing means and the second storing means.

2. A liquid crystal display as claimed in claim 1, wherein the liquid crystal driving voltage having a different polarity for every one frame is a voltage obtained by alternately applying, to the liquid crystal layer, the liquid crystal driving voltage for the present frame and the liquid crystal driving voltage for the one-preceding frame.

3. A liquid crystal display as claimed in claim 1, wherein the first storing means stores a liquid crystal driving voltage having a positive polarity; and wherein the second storing means stores a liquid crystal driving voltage having a negative polarity.

4. A liquid crystal display comprising:

a pair of substrates; and a liquid crystal layer held by the pair of substrates in such a manner as to be sandwiched therebetween;

a plurality of first scanning signal lines formed on one substrate of the pair of substrates;

a plurality of second scanning signal lines formed on the one substrate between the plurality of first scanning signal lines; and a plurality of data signal lines formed on the one substrate in a matrix-like structure with reference to the plurality of first scanning signal lines and the plurality of second scanning signal lines;

wherein a plurality of pixel circuits, which drive liquid crystal molecules in the liquid crystal layer and are connected to the plurality of first scanning signal lines, the plurality of second scanning signal lines, and the plurality of data signal lines, are formed in domains surrounded by the plurality of first scanning signal lines, the plurality of second scanning signal lines, and the plurality of data signal lines, each of the plurality of pixel circuits including first voltage holding means connected to a corresponding first scanning signal line and a corresponding data signal line so as to hold an image signal voltage from the corresponding data signal line, second voltage holding means connected to a corresponding second scanning signal line and a corresponding data signal line so as to hold an image signal voltage from the corresponding data signal line, switching means which, in response to a switching signal, switches between an output voltage of the first voltage holding means and an output voltage of the second voltage holding means so as to output a switched output voltage, and a pixel electrode connected to the switching means so as to apply the switched output voltage from the switching means to the liquid crystal layer.

5. A liquid crystal display as claimed in claim 4, wherein the first voltage holding means holds an image signal voltage having a positive polarity; and wherein the second voltage holding means holds an image signal voltage having a negative polarity.

6. A liquid crystal display as claimed in claim 5, wherein an operation period of the first voltage holding means and an operation period of the second voltage holding means are different from an operation period of the switching means.

7. A liquid crystal display as claimed in claim 4, wherein the switching means switches between the first voltage holding means and the second voltage holding means at least one time within one frame time period.

8. A liquid crystal display as claimed in claim 4, wherein a common electrode is formed on another substrate of the pair of substrates; and wherein a voltage, having a polarity which is opposite to a polarity of the liquid crystal driving voltage applied to the pixel electrode, is applied to the common electrode.

9. A liquid crystal display as claimed in claim 4, wherein the first voltage holding means includes a first switching element, a first capacitance element, and a first buffer amplifier; and wherein the second voltage holding means includes a second switching element, a second capacitance element, and a second buffer amplifier.

10. A liquid crystal display as claimed in claim 9, wherein the first switching element includes a first P type transistor; and wherein the second switching element includes a first N type transistor.

11. A liquid crystal display as claimed in claim 10, wherein the first buffer amplifier is a voltage follower circuit which includes a second N type transistor; and wherein the second buffer amplifier is a voltage follower circuit which includes a second P type transistor.

12. A liquid crystal display as claimed in claim 11, wherein transistors formed in the pixel circuit are all N type transistors or are all P type transistors.

* * * * *